US011237508B2

(12) United States Patent
Ikeno

(10) Patent No.: US 11,237,508 B2
(45) Date of Patent: Feb. 1, 2022

(54) FUSER

(71) Applicant: BROTHER KOGYO KABUSHIKI KAISHA, Nagoya (JP)

(72) Inventor: Yuichi Ikeno, Maibara (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/211,298

(22) Filed: Mar. 24, 2021

(65) Prior Publication Data

US 2021/0318647 A1 Oct. 14, 2021

(30) Foreign Application Priority Data

Apr. 14, 2020 (JP) ..... JP2020-072045

(51) Int. Cl.
*G03G 15/20* (2006.01)

(52) U.S. Cl.
CPC ..... *G03G 15/2053* (2013.01); *G03G 15/2028* (2013.01)

(58) Field of Classification Search
CPC ..... G03G 15/2053; G03G 15/2028
See application file for complete search history.

(56) References Cited

U.S. PATENT DOCUMENTS

2013/0084111 A1* 4/2013 Iwata ..... G03G 15/2053 399/329
2014/0186078 A1* 7/2014 Imaizumi ..... G03G 15/2057 399/329
2016/0139551 A1* 5/2016 Narahara ..... G03G 15/55 399/33
2016/0170351 A1 6/2016 Suzuki et al.
2020/0033774 A1* 1/2020 Shinji ..... G03G 15/2053
2020/0183307 A1* 6/2020 Furuichi ..... G01K 1/14

FOREIGN PATENT DOCUMENTS

JP 9-325628 A 12/1997
JP 2016-114619 A 6/2016
JP 2019-15840 A 1/2019

* cited by examiner

*Primary Examiner* — Sevan A Aydin
(74) *Attorney, Agent, or Firm* — Merchant & Gould P.C.

(57) ABSTRACT

A fuser, having a heater, a holder, and a first wire spring, is provided. The heater is in a form of a planar plate and has a first face and a second face. The holder has a supporting base supporting the first face of the heater. The first wire spring retain the heater on the holder. The first wire spring has a first facing portion, a first engageable portion, and a second engageable portion. The first facing portion faces and supports the second face of the heater. The first engageable portion and the second engageable portion extend from one and the other ends of the first facing portion. The first engageable portion and the second engageable portion are engageable with the holder in an end area on one side and an end area on the other side of the heater in a widthwise direction.

17 Claims, 11 Drawing Sheets

FUSER

CROSS REFERENCE TO RELATED APPLICATION

This application claims priority from Japanese Patent Application No. 2020-072045, filed on Apr. 14, 2020, the entire subject matter of which is incorporated herein by reference.

BACKGROUND

Technical Field

An aspect of the present disclosure is related to a fuser having a planar heater.

Related Art

A fuser having a planar heater is known. The heater may be attached to a holder through a connector and a clip. For example, the connector may nip the heater and the holder at an end area of the heater on one side in a lengthwise direction, and the clip may nip the heater and the holder at the other end area on the other side in the lengthwise direction. The clip may be in a form of a leaf spring having a breadth of some extent along the lengthwise direction.

SUMMARY

In order to reserve a lengthwise range to attach the clip with the breadth in the heater and the holder, a dimension of the heater and the holder in the lengthwise direction may be increased.

The present disclosure is advantageous in that a fuser, in which lengthwise dimensions of a heater and a holder may be reducible, is provided.

According to an aspect of the present disclosure, a fuser having a heater, a holder, and a first wire spring, is provided. The heater is in a form of a planar plate and has a first face and a second face opposite to the first face. The holder has a supporting base. The supporting base supports the first face of the heater. The first wire spring retains the heater on the holder. The first wire spring has a first facing portion facing and supporting the second face of the heater, a first engageable portion, and a second engageable portion. The first engageable portion extends from one end of the first facing portion, and is engageable with the holder in an end area on one side of the heater in a widthwise direction. The widthwise direction intersects orthogonally with a lengthwise direction of the heater. The second engageable portion extends from the other end of the first facing portion and is engageable with the heater in an end area on the other side of the heater in the widthwise direction.

BRIEF DESCRIPTION OF THE ACCOMPANYING DRAWINGS

Figure 11A:
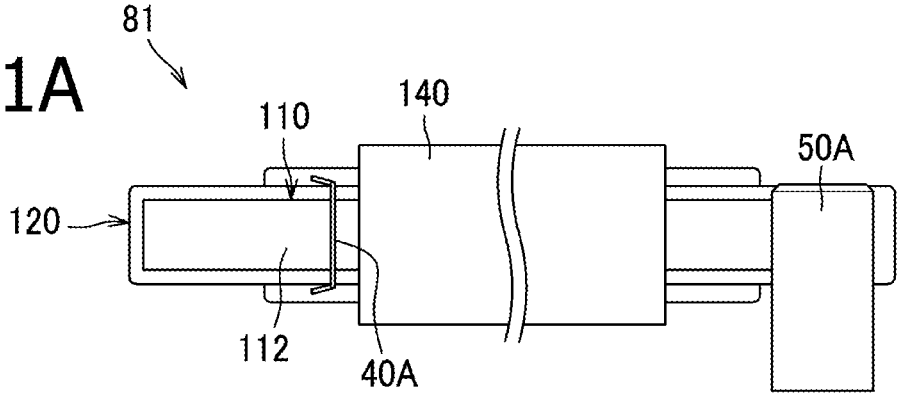
Figure 11B:
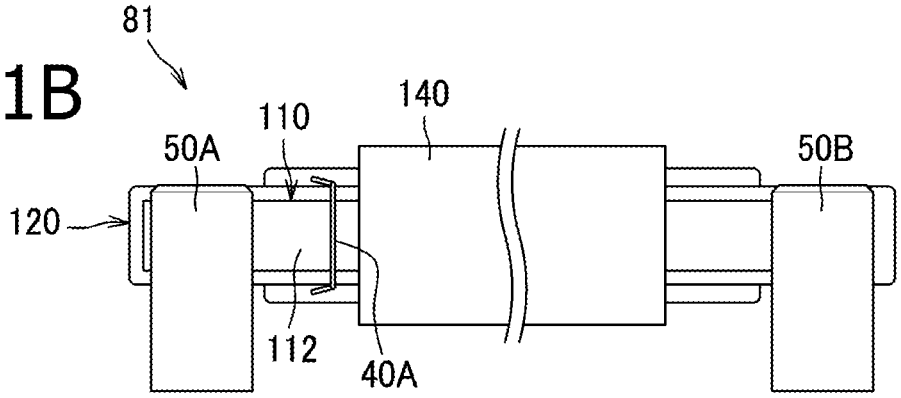
Figure 11C:
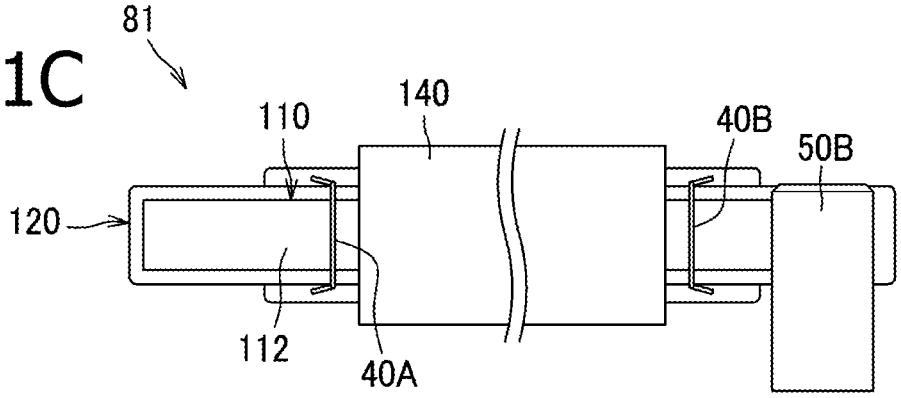
Figure 11D:
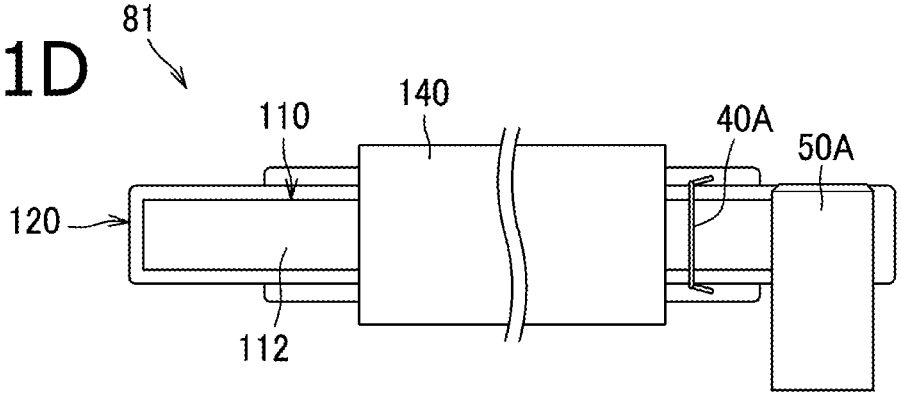

FIG. 11A is a plan view of a heater unit having a first wire spring in an end area on one side and a first connector in an end area on the other side according to a first modified example of the embodiment of the present disclosure. FIG. 11B is a plan view of a heater unit having a first wire spring and a second connector in an end area on one side and a first connector on an end area on the other side according to a second modified example of the embodiment of the present disclosure. FIG. 11C is a plan view of a heater unit having a first wire spring in an end area on one side and a first connector and a second wire spring in an end area on the other side according to a third modified example of the embodiment of the present disclosure. FIG. 11D is a plan view of a heater unit having a first wire spring and a first connector in an end area on one side according to a fourth modified example of the embodiment of the present disclosure.

Figure 12:
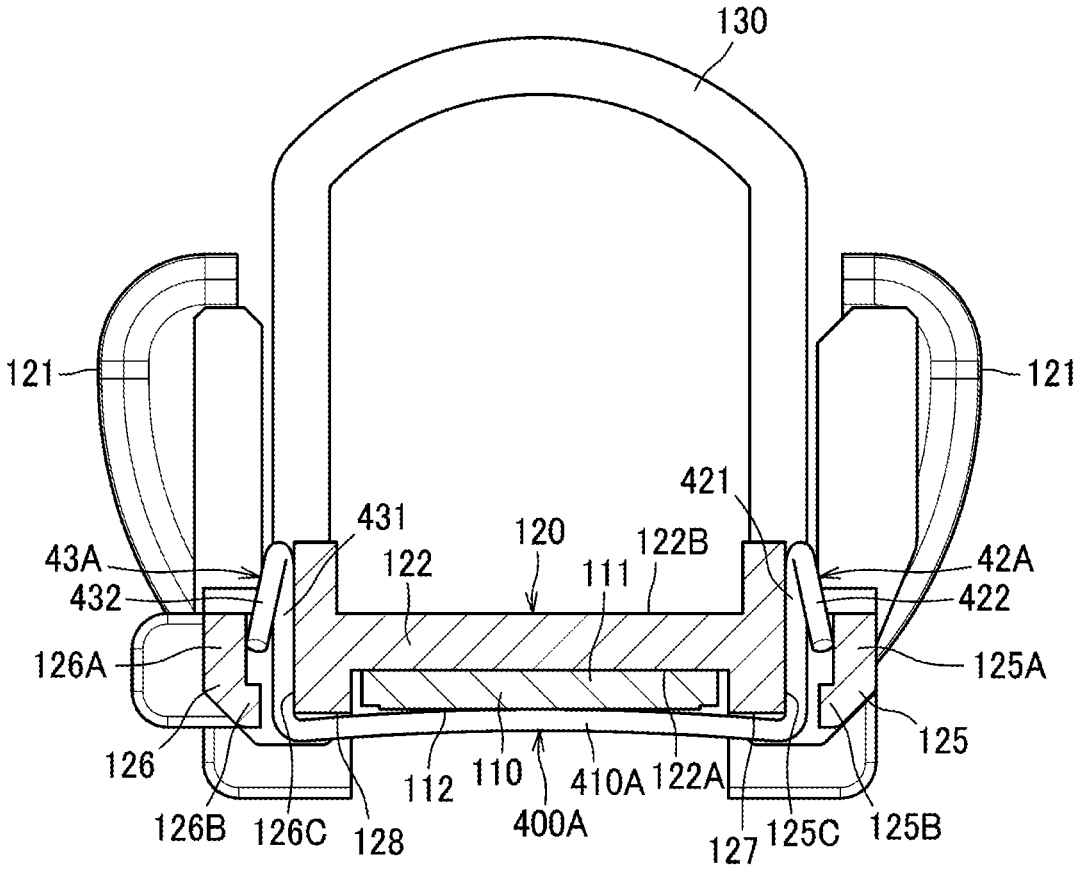

FIG. 12 is a cross-sectional view of a heater unit with a first wire spring in a fifth modified example of the embodiment of the present disclosure.

DETAILED DESCRIPTION

Figure 1:
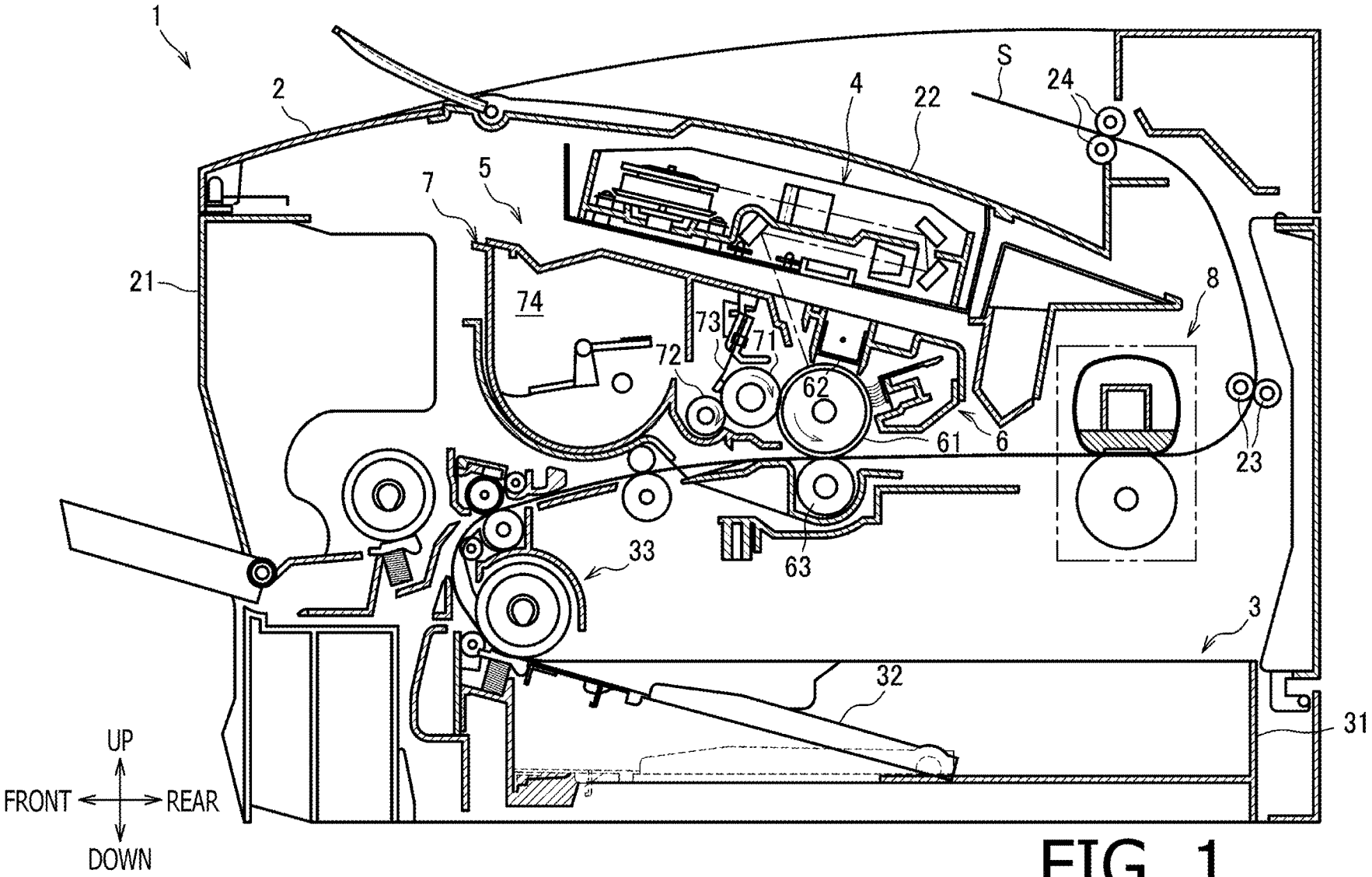
FIG. 1 is an illustrative cross-sectional view of a laser printer with a fuser according to an embodiment of the present disclosure.

Hereinafter, an embodiment of the present disclosure will be described with reference to the accompanying drawings. As shown in FIG. 1, a laser printer 1 includes a feeder 3, an exposure device 4, a process cartridge 5, and a fuser 8, which are stowed in a casing 2.

The feeder 3 is located at a lower position in the casing 2 and includes a feeder tray 31, a lifting plate 32, and a feeder device 33. The feeder tray 31 may store sheets S therein. The sheets S may be lifted upward by the lifting plate 32 and fed to the process cartridge 5 by the feeder device 33.

The exposure device 4 is located at an upper position in the casing 2 and includes a light source, which is not shown, and polygon mirrors, lenses, and reflective mirrors, which are shown in FIG. 1 but not signed. In the exposure device 4, the light source may emit a laser beam to scan a surface of a photosensitive drum selectively based on image data to expose the surface of a photosensitive drum 61.

The process cartridge 5 is located at a lower position with respect to the exposure device 4 and is detachable from the casing 2 through an opening, which is exposed when a front cover 21 on the casing 2 is open. The process cartridge 5 includes a drum unit 6 and a developing unit 7. The drum unit 6 includes the photosensitive drum 61, a charger 62, and a transfer roller 63. The developing unit 7 is detachable from the drum unit 6 and includes a developing roller 71, a supplier roller 72, a flattening blade 73, and a container 74 to contain a toner.

In the process cartridge 5, the surface of the photosensitive drum 61 may be charged evenly by the charger 62 and exposed to the laser beam from the light source in the exposure device 4. Thereby, an electrostatic latent image based on the image data may be formed on the photosensitive drum 61. Meanwhile, the toner in the container 74 may be supplied to the developing roller 71 through the supplier roller 72 and enter a position between the developing roller 71 and the flattening blade 73. The toner may be flattened evenly by the flattening blade 73 to form an evenly flattened layer on the developing roller 71. The toner may be thereafter supplied from the developing roller 71 to the electrostatic latent image formed on the photosensitive drum 61. Thus, the electrostatic latent image may be developed to form a visible toner image on the photosensitive drum 61. As the sheet S is conveyed through a position between the photosensitive drum 61 and the transfer roller 63, the toner image on the photosensitive drum 61 may be transferred onto the sheet S.

The fuser 8 is located at a position downstream from the process cartridge 5 in a conveying direction, in which the sheet S is conveyed. The sheet S with the toner image transferred thereon may be conveyed through the fuser 8 to have the toner image fixed thereon by fusing. The sheet S with the toner image fused thereon may be ejected outside the casing 2 by conveyer rollers 23, 24 to rest on an ejection tray 22.

Figure 2:
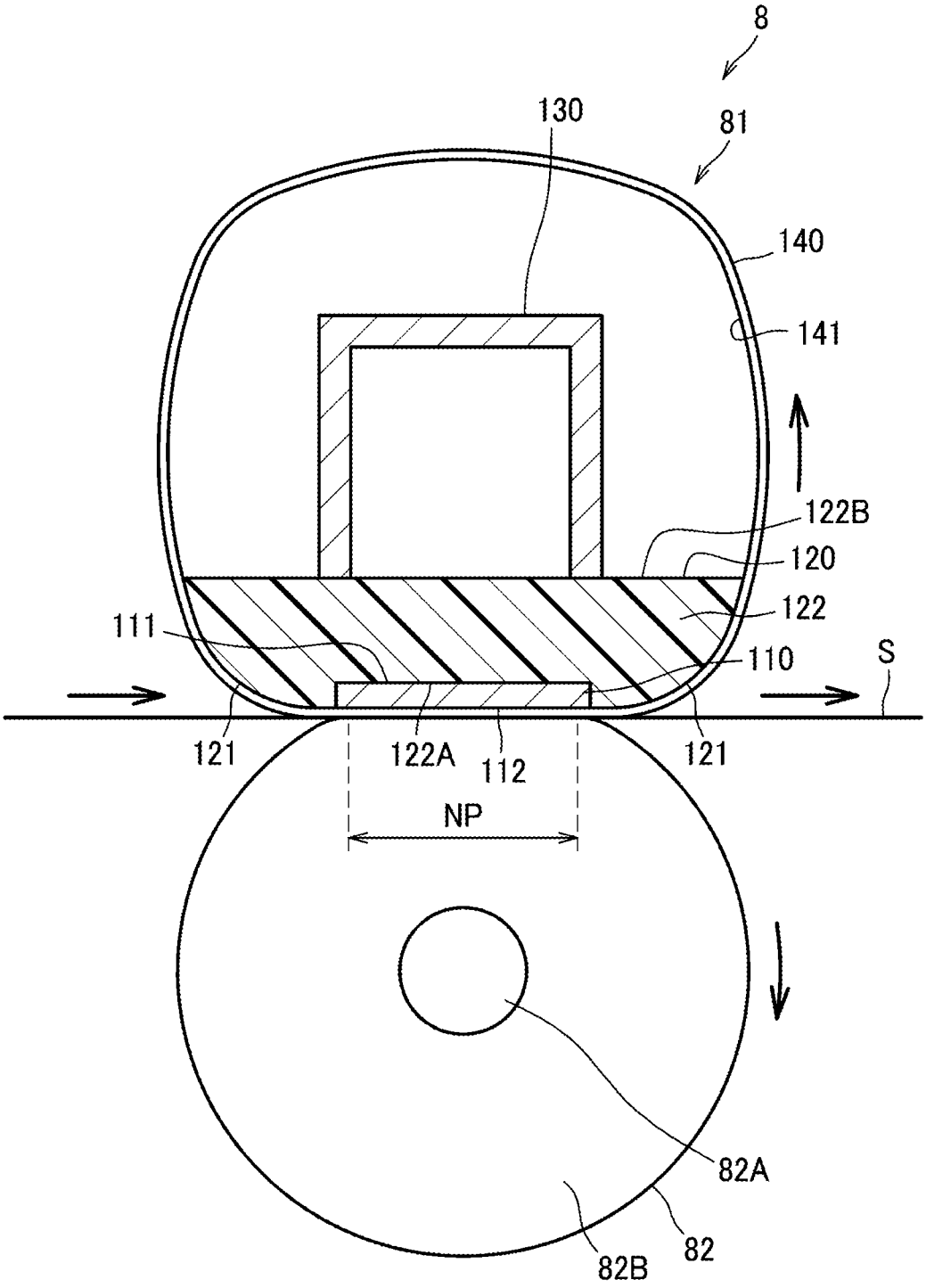
FIG. 2 is an illustrative cross-sectional view of the fuser according to the embodiment of the present disclosure.

As shown in FIG. 2, the fuser 8 includes a heater unit 81 and a pressure roller 82. One of the heater unit 81 and the pressure roller 82 may be urged against the other by an urging mechanism, which is not shown.

The heater unit 81 includes a heater 110, a holder 120, a stay 130, and a belt 140. The heater 110 may be an elongated planar plate and has a first face 111 and a second face 112 being on a reverse side of the first face 111. The heater 110 is supported by the holder 120 at the first face 111. In the following description, a direction of longer sides of the heater 110 may be called as a lengthwise direction, and a direction of shorter sides of the heater 110 may be called as a widthwise direction.

The holder 120 may be made of, for example, resin and has a guide face 121 and a supporting base 122. The guide face 121 may contact an inner circumferential surface 141 of the belt 140 and guide the belt 140. The supporting base 122 has a supporting face 122A to support the heater 110. The stay 130 supports the holder 120 and may be formed by bending a plate having greater rigidity than the holder 120, e.g., a steel plate, into an approximate shape of U in a cross-sectional view.

The belt 140 is an endless belt having heat-tolerance properties and flexibility and includes a base tube made of metal such as stainless steel and a fluorine resin layer coating the metal base tube. The heater 110, the holder 120, and the stay 130 are arranged inside the belt 140. The belt 140 is arranged to rotate around the heater 110, the holder 120, and the stay 130. The inner circumferential surface 141 of the belt 140 contacts the heater 110.

The pressure roller 82 includes a shaft 82A made of metal and an elastic layer 82 coating the shaft 82A. The pressure roller 82 forms a nipping portion NP, in which the belt 140 is nipped between the heater 110 and the pressure roller 82 to apply heat and pressure to the sheet S.

The pressure roller 82 may be driven by a driving force transmitted from a motor, which is not shown but is located inside the casing 2, to rotate. As the pressure roller 82 rotates, a friction force produced between the pressure roller 82 and the belt 140 or the sheet S may cause the belt 140 to rotate passively. Thus, the transferred toner image may be thermally fixed to the sheet S as the sheet S is conveyed between the pressure roller 82 and the heated belt 140.

Figure 3:
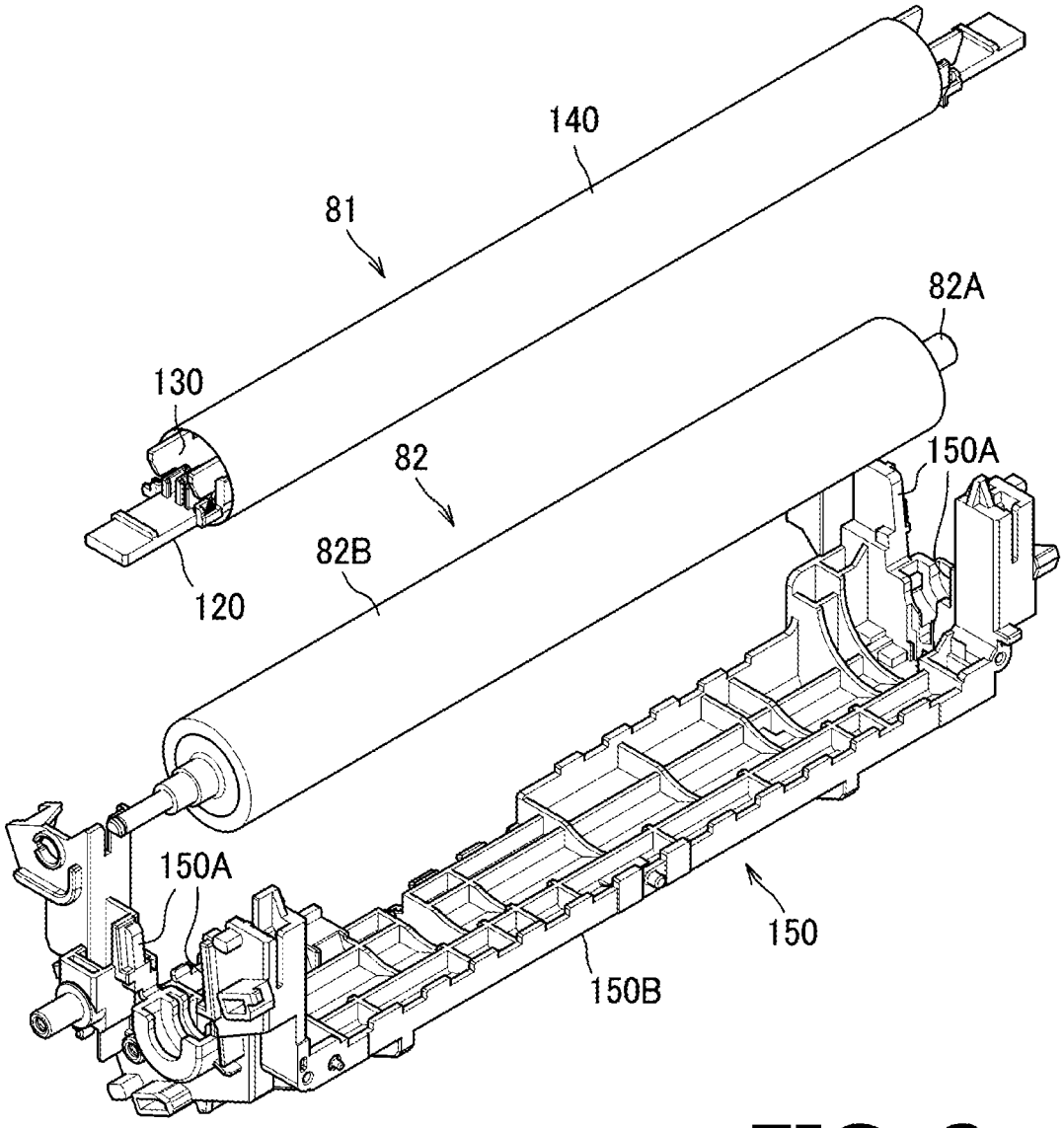
FIG. 3 is an exploded view of the fuser according to the embodiment of the present disclosure.
Figure 4:
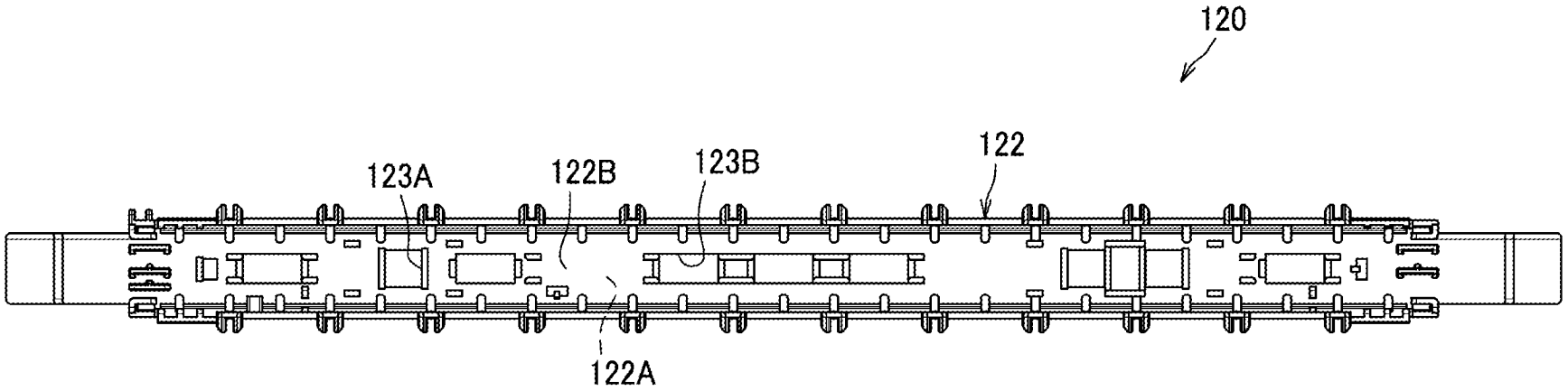
FIG. 4 is a plan view of an upper side of a holder in the fuser according to the embodiment of the present disclosure.

As shown in FIG. 3, the fuser 8 further includes a fuser frame 150. The fuser frame 150 supports the heater unit 81 and the pressure roller 82. The fuser frame 150 includes paired rails 150A on each lengthwise end thereof. The rails 150A support the holder 150 to be movable in a direction of thickness, which intersects orthogonally with the lengthwise direction and the widthwise direction. In the following paragraphs, the direction of thickness, which intersects orthogonally with the lengthwise direction and the widthwise direction, may be called as a thickness direction.

Each rail 150A may be in a columnar form extending from a body 150B of the fuser frame 150 in the thickness direction. The paired rails 150A face each other along the widthwise direction. Faces of the paired rails 150 that face each other may contact contacting areas F in the holder 120 (see FIG. 7), which will be described further below. A distance between the paired rails 150A in the widthwise direction may be equal to or marginally larger than a distance between the contacting area F on one side of the holder 120 in the widthwise direction and the contacting area F on the other side of the holder 120 in the widthwise direction. The form of the rails 150A may not necessarily be limited to the columnar form extending in the thickness direction as long as the rails may support the holder 120 movably in the thickness direction.

Figure 5:
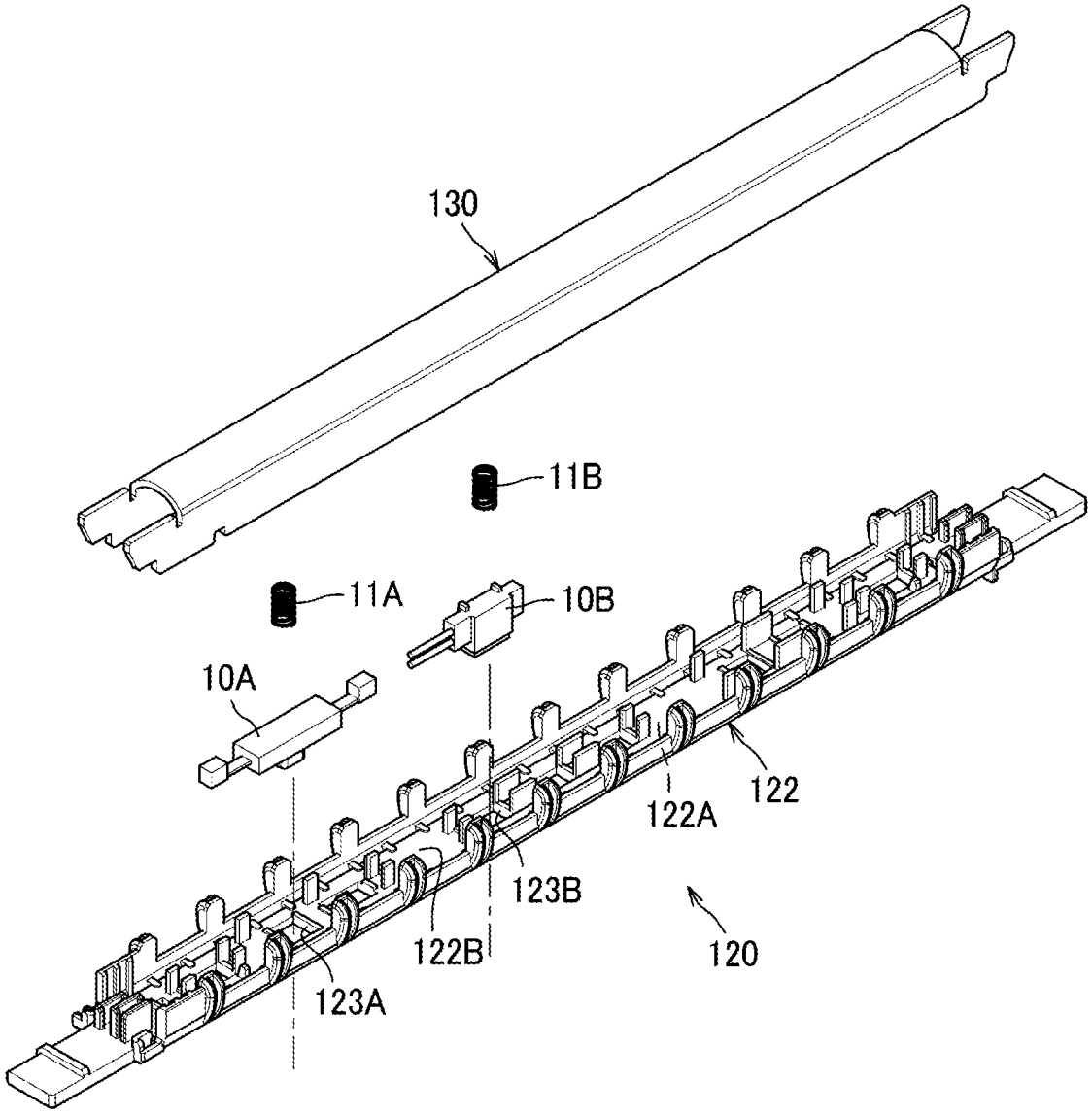
FIG. 5 is an exploded view of the holder, with temperature sensors, urging members, and a stay, in the fuser according to the embodiment of the present disclosure.

The supporting baser 112 in the holder 120 has at least one opening for at least one temperature sensor. In particular, as shown in FIG. 5, the supporting base 112 in the holder 120 may have openings 123A, 123B for temperature sensors 10A, 10B. The temperature sensors 10A, 10B are arranged to face a reverse face 122B of the holder 120, which is opposite to the supporting face 122A. The temperature sensors 10A, 10B are arranged to contact the first face 111 of the heater 110 through the openings 123A, 123B. The temperature sensors 10A, 10B are urged against the first face 111 of the heater 110 by urging members 11A, 11B, which are arranged between the stay 130 and the temperature sensors 10A, 10B. The temperature sensor 10A is located at an end area in the holder 120 on one side in the lengthwise direction. The temperature sensor 10B is located at a position closer to the end area on the one side than a center of the holder 120 in the lengthwise direction. The temperature sensors 10A, 10B may be, but not necessarily limited to, thermistors. Optionally, for another example, the temperature sensors 10A, 10B may be temperature sensors of another type such as thermostat. The urging members 11A, 11B may be, but not necessarily limited to, coil springs.

Figure 6:
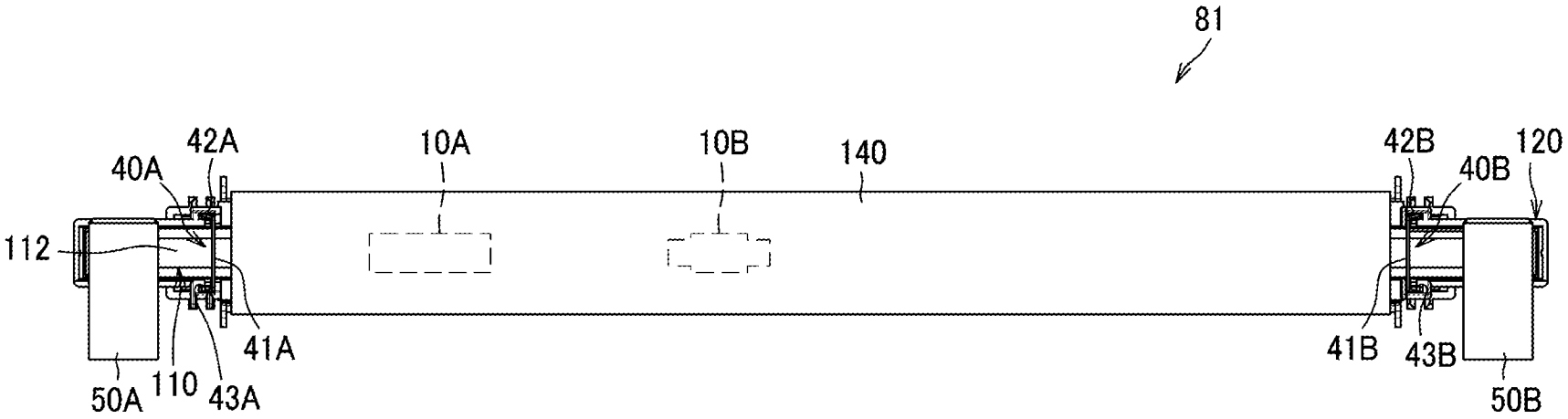
FIG. 6 is a plan view of a heater unit in the fuser according to the embodiment of the present disclosure.

As shown in FIG. 6, the holder 120 extends in the lengthwise direction through the belt 140, with lengthwise ends thereof protruding outward from the belt 140. The holder 120 supports the heater 110, and in an end area on one side of the heater 110 in the lengthwise direction, a first wire spring 40A and a first connector 50A are arranged. The first wire spring 40A may retain the heater 110 onto the holder 120, and the first connector 50A may nip the heater 110 and the holder 120. In another end area on the other side of the heater 110 in the lengthwise direction, a second wire spring 40B and a second connector 50B are arranged. The second wire spring 40B may retain the heater 110 onto the holder 120, and the second connector 50B may supply power to the heater 110 and nip the heater 110 and the holder 120. The temperature sensors 10A, 10B are located at positions closer to the first wire spring 40A than the second connector 50B in the lengthwise direction.

The first wire spring 40A is located between the belt 140 and the first connector 50A. The second wire spring 40B is located between the belt 140 and the second connector 50B. A shortest distance between the first wire spring 40A and the belt 140 and a shortest distance between the second wire spring 40B and the belt 140 are both shorter than a shortest distance between the first connector 50A and the belt 140 and than a shortest distance between the second connector 50B and the belt 140. Moreover, the shortest distance between the first wire spring 40A and the belt 140 is shorter than a shortest distance between the first wire spring 40A and the first connector 50A and than a shortest distance between the second wire spring 40B and the second connector 50B. Furthermore, the shortest distance between the second wire spring 40B and the belt 140 is shorter than the shortest distance between the first wire spring 40A and the first connector 50A and than the shortest distance between the second wire spring 40B and the second connector 50B. The first and second wire springs 40A, 40B and the first and second connectors 50A, 50B will be described further below.

Next, a structure of the holder 120 at each end area in the lengthwise direction will be described below. The structure of the holder 120 at the lengthwise end areas are symmetrical; therefore, one of the end areas on one side in the lengthwise direction will be representatively described.

Figure 7:
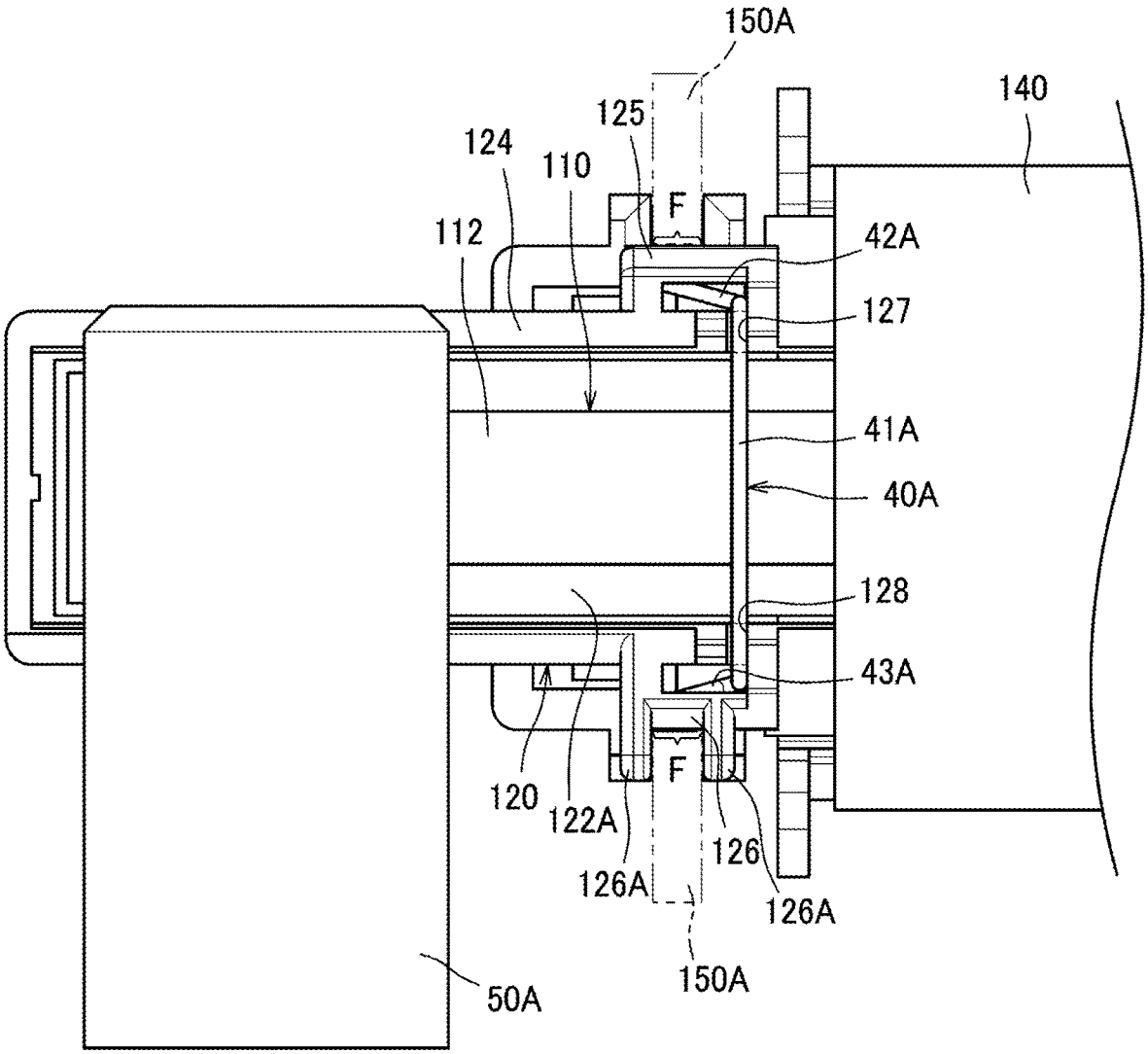
FIG. 7 is a partially enlarged view of the heater unit at an end area on one side in a lengthwise direction according to the embodiment of the present disclosure.
Figure 10:
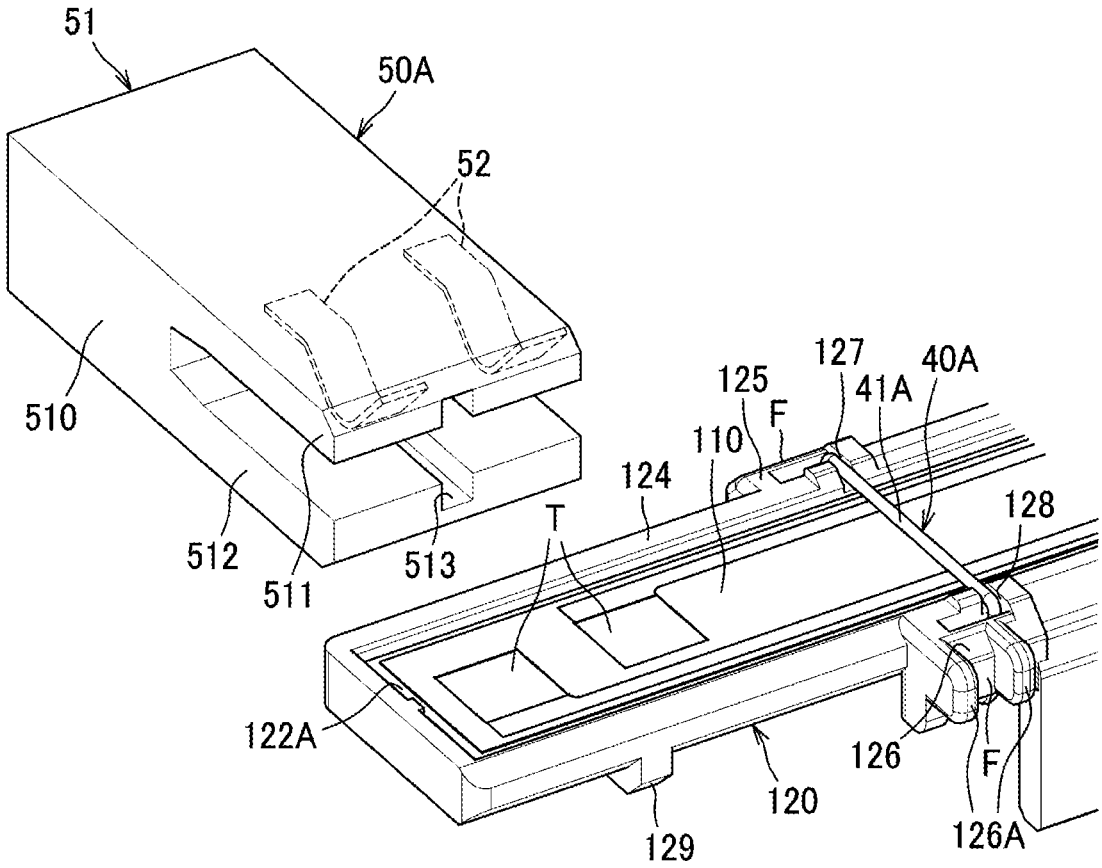
FIG. 10 is an exploded view of the holder and a connector detached from the holder according to the embodiment of the present disclosure.

As shown in FIGS. 7 and 10, the holder 120 has a side wall 124, a first contact portion 125, a second contact portion 126, a first groove 127, a second groove 128, and a protrusive portion 129.

The side wall 124 protruding from the supporting face 122A is arranged along a periphery of the supporting base 122. The side wall 124 includes two (2) side walls 124 that extend along the lengthwise direction. The first contact portion 125 protrudes in the widthwise direction from one of the side walls 124 that extend along the lengthwise direction. The second contact portion 126 protrudes in the widthwise direction from the other of the side walls 124 that extend along the lengthwise direction. The first contact portion 125 and the second contact portion 126 provide the contacting areas F, which may contact the rails 1250A. A dimension of the first contact portion 125 and a dimension of the second contact portion 126 in the lengthwise direction are both larger than a lengthwise dimension of the faces of the rails 150 that face each other. The second contact portion 126 has a protrusive portion 126A, which may restrict the holder 126 from moving with respect to the rails 150A in the lengthwise direction. With the protrusive portion 126A, the holder 120 may be located at a correct position in the lengthwise direction with respect to the fuser frame 150. The first groove 127 is located in the side wall 124 between the first contact portion 125 and the supporting face 122A. The second groove 128 is located in the side wall 124 between the second contact portion 126 and the supporting face 122A. The protrusive portion 129 may, as described further in detail, engage with grooves 513 in the first and second connectors 50A, 50B.

Figure 8:
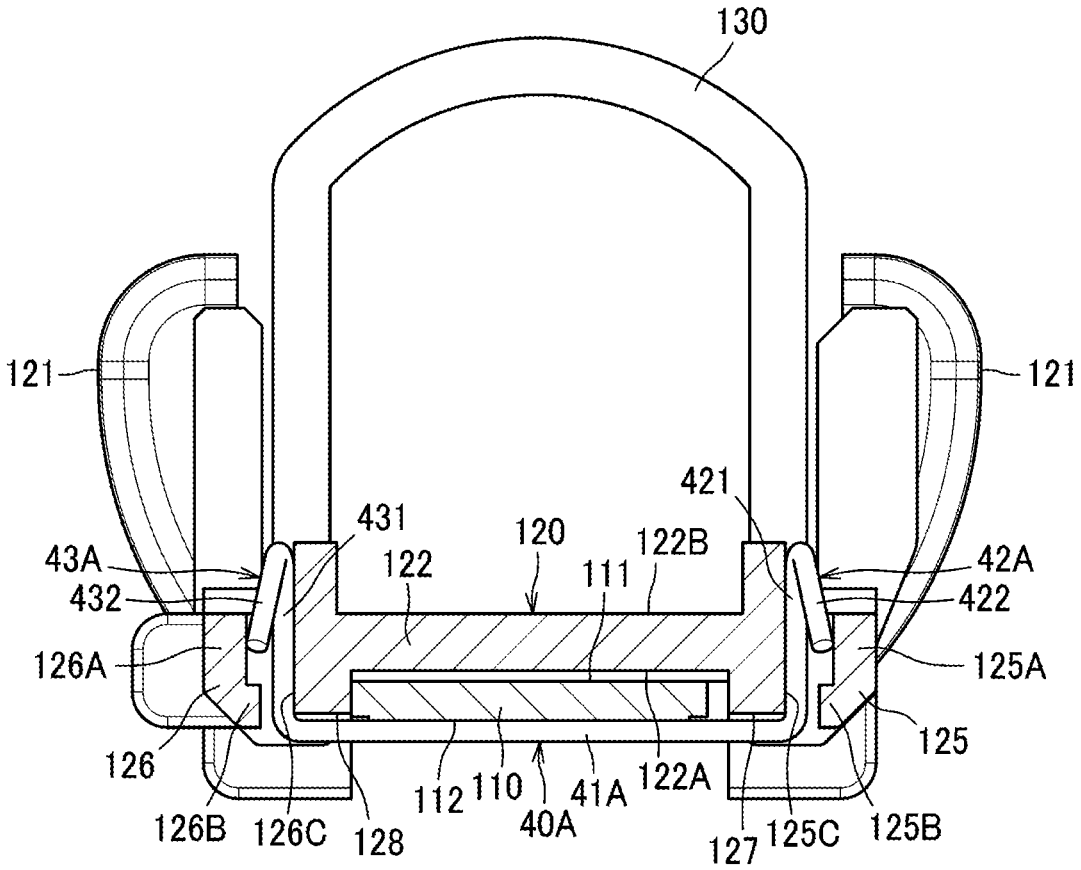
FIG. 8 is a cross-sectional view of the heater unit with a first wire spring in the fuser according to the embodiment of the present disclosure.

As shown in FIGS. 7 and 8, the first contact portion 125 includes a first contact wall 125A, a first stopper portion 125B, and an attachable hole 125C. The first contact wall 125A extends in the thickness direction, and the first stopper portion 125B extends in the widthwise direction from the first contact wall 125A toward the supporting base 122. The attachable hole 125C is formed between the first contact wall 125A and the supporting base 122 and between the first stopper portion 125B and the supporting base 122. The second contact portion 126 includes a second contact wall 126A, the second stopper portion 126B, and an attachable hole 126C. The second contact wall 126A extends in the thickness direction, and the second stopper portion 126B extends in the widthwise direction from the second contact wall 126A toward the supporting base 122. The attachable hole 126C is formed between the second contact wall 126A and the supporting base 122 and between the second stopper portion 126B and the supporting base 122.

Next, structures of the first and second wire springs 40A, 40B will be described below. As shown in FIG. 6, the first wire spring 40A includes a first facing portion 41A, a first engageable portion 42A, and a second engageable portion 43A. The first facing portion 41A faces the second face 112 of the heater 110 and supports the second face 112. The first facing portion 41A extends straight in the widthwise direction across second face 112. The first engageable portion 42A extends from one end of the first facing portion 41A and may engage with the holder 120 on one side in the widthwise direction. The second engageable portion 43A extends from the other end of the first facing portion 41A and may engage with the holder 120 on the other side in the widthwise direction.

The second wire spring 40B includes a second facing portion 41B, a third engageable portion 42B, and a fourth engageable portion 43B. The second facing portion 41B faces the second face 112 of the heater 110 and supports the second face 112. The second facing portion 41B extends straight in the widthwise direction across the second face 112. The third engageable portion 42B extends from one end of the second facing portion 41B and may engage with the holder 120 on the one side in the widthwise direction. The fourth engageable portion 43B extends from the other end of the second facing portion 41B and may engage with the holder 120 on the other side in the widthwise direction.

The first wire spring 40A and the second wire spring 40B have the same form and are located at symmetrical positions in the lengthwise direction. Therefore, in the following paragraphs, the first wire spring 40A will be representatively described.

Figure 9:
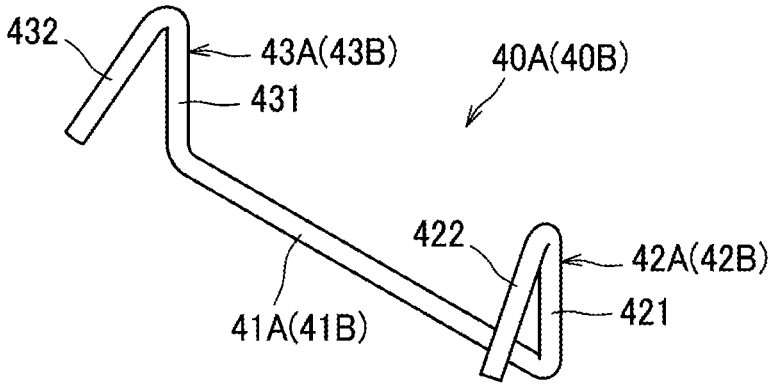
FIG. 9 is a perspective view of the first wire spring according to the embodiment of the present disclosure.

The first wire spring 40A may be a piece of metal wire bent in a form as shown in FIG. 9. The first engageable portion 42A includes a first extended portion 421 extending in the thickness direction from the first facing portion 41A and a first turnback portion 422 bent at an end of the first extended portion 421 to extend in a direction different from the first extended portion 421 and the first facing portion 41A. The second engageable portion 43A includes a second extended portion 431 extending in the thickness direction from the first facing portion 41A and a second turnback portion 432 bent at an end of the second extended portion 431 to extend in a direction different from the second extended portion 431 and the first facing portion 41A. The first turnback portion 422 extends from the first extended portion 421 toward the first facing portion 41A in the thickness direction and outward in the widthwise direction. The second turnback portion 432 extends from the first extended portion 421 toward the first facing portion 41A in the thickness direction and outward in the widthwise direction.

As shown in FIG. 7, the first wire spring 40A is in an arrangement such that at least a part of the first wire spring 40A is located in a range, in which the contacting areas F are located, in the lengthwise direction. In particular, at least a part of the first engageable portion 42A and at least a part of the second engageable portion 43A are located in the range, where the contacting areas F are located, in the lengthwise direction. In other words, at least a part of the first engageable portion 42A and at least a part of the second engageable portion 43A are located in a range coincident with the contacting areas F in the lengthwise direction. The contacting areas F are located at a position in the lengthwise direction different from the belt 140 and from the first and second connectors 50A, 50B. While the part of the first wire spring 40B is located in the lengthwise range coincident with the contacting area F, which requires a certain length in the lengthwise direction, an additional lengthwise range, which may otherwise be required solely for a purpose of attaching the first wire spring 40A to the holder 120, may be omitted. Therefore, the dimension of the holder 120 and the heater 110 in the lengthwise direction may be reduced.

The first facing portion 41A may fit in and engage with the first groove 127 and the second groove 128. As shown in FIG. 8, the first engageable portion 42A may be placed to contact the first contact wall 125A in an elastically deformed form, and the second engageable portion 43A may be placed to contact the second contact wall 126A in an elastically deformed form. In particular, the first turnback portion 422 may contact the first contact wall 125A, and the second turnback portion 432 may contact the second contact wall 126A.

The first engageable portion 42A may be restrained from moving in the thickness direction by the first stopper portion 125B and separating from the holder 120. The second engageable portion 43A is restrained from moving in the thickness direction by the second stopper portion 126B and separating from the holder 120. The first stopper portion 125B is located to be closer to the first facing portion 41A than the first turnback portion 422 and overlaps the first turnback portion 422 in a view along the thickness direction. The second stopper portion 126B is located to be closer to the first facing portion 41A than the second turnback portion 432 and overlaps the second turnback portion 432 in the view along the thickness direction.

The first engageable portion 42A and the second engageable portion 43A contact the stay 130, and the stay 130 is electrically grounded. Therefore, the first wire spring 40A is grounded through the stay 130. Alternatively, the first engageable portion 42A and the second engageable portion 43A may be grounded by being indirectly connected to the stay 130 through conductive members such as metal wires.

Next, structure of the first and second connectors 50A, 50B will be described below. The first and second connectors 50A, 50B have a same structure; therefore, the first connector 50A will be described representatively and may be called as the connector 50A. The connector 50A may supply power to the heater 110. As shown in FIG. 10, the connector 50A may also serve as a fixing member, which may fix a part of the heater 110 to the holder 120. The connector 50A is attached sideward to an end area of the heater 110 and the holder 120 on one side in the widthwise direction. The connector 50A includes a connector body 51, which may be made of resin, and two (2) electrodes 52, which may be made of a conductive material such as metal.

One and the other of the electrodes 52 are connectable to one and the other of power-supply terminals T, respectively, and align spaced apart from each other along the lengthwise direction. The electrodes 52 are connected to a power source through wires, which are not shown.

The connector body 51 includes a base portion 510 having a rectangular shape, a first extended portion 511 and a second extended portion 512, which extend from the base portion 510 to the heater 110. The first extended portion 511 and the second extended portion 512 are spaced apart from each other and align in the thickness direction. The first extended portion 511 and the second extended portion 512 may nip the heater 110 and the holder 120 in the thickness direction.

On a surface of the second extended portion 512 that faces toward the first extended portion 511, a groove 513 is formed. The groove 513 may receive the protrusion 129 to fit and engage with the protrusion 129 in the lengthwise direction and restrict the first connector 50A from moving in the lengthwise direction with respect to the holder 120.

Next, benefits achievable from the fuser 8 according to the present embodiment will be described below.

When the fuser 8 is being assembled, first, the heater 110 may be placed on the supporting face 122A of the holder 122A. Next, the first wire spring 40A may be attached to the holder 120. In particular, the first engageable portion 42A and the second engageable portion 43A may be inserted in the attachable holes 125C, 126, respectively, and the facing portion 41A may be engaged with the grooves 127, 128. The second wire spring 40B may be attached to the holder 120 in the same manner. Thus, the heater 110 may be retained by the holder 120. Thereafter, the temperature sensors 10A, 10B may be attached to the heater 110 in an arrangement such that the temperature sensors 10A, 10B should contact the heater 110. While the temperature sensors 10A, 10B are being attached to the heater 110, the first and second wire springs 40A, 40B retain the heater 110. Therefore, the temperature sensors 10A, 10B may be attached to the holder 120 easily.

Next, the holder 120 may be installed in the heater unit 81. When the holder 120 is installed in the heater unit 81, as shown in FIG. 2, the heater 110 may be placed in an orientation, in which the second face 112 faces downward, toward the heat roller 82. In this orientation, with the first and second wire springs 40A, 40B retaining the heater 110, the heater 110 may be restrained from falling off from the holder 120.

When the laser printer 1 is operating to print an image, the pressure roller 82 may rotate, and the belt 140 may be rotated by a friction force produced between the belt 140 and the pressure roller 82. By the friction produced between the belt 140 and the pressure roller 82, the belt 140 may be electrically charged. Meanwhile, the first and second wire springs 40A, 40B being grounded are located between the belt 140 and the first connector 50A and between the belt 140 and the second connector 50B, respectively. The charged electricity in the belt 140 may be discharged to the first and second wire springs 40A, 40B and removed from the belt 140. Therefore, the electricity charged in the belt 140 may be restrained from being discharged to the first or second connector 50A, 50B. Moreover, the belt 140 may reciprocate in the lengthwise direction while the laser printer 1 is operating; therefore, with the first and second wire springs 40A, 40B located on one and the other sides of the belt 140 in the lengthwise direction, the charged electricity may be removed from the belt 140 reliably.

According to the embodiment described above, benefits described below may be achievable.

With the first wire spring 40A retaining the heater 110 on the holder 120, the dimension of the heater 110 and the holder 120 in the lengthwise direction may be reduced.

The first wire spring 40A is in the arrangement, in which at least a part of the first wire spring 40A is located in the range, where the contacting area F of the holder 120 is located, in the lengthwise direction. Therefore, the dimension of the heater 110 and the holder 120 in the lengthwise direction may be effectively reduced.

The first wire spring 40A is grounded, and the shortest distance between the first wire spring 40A and the belt 140 is shorter than the shortest distance between the first connector 50A and the belt 140. Therefore, the electricity charged in the belt 140 may be restrained from being discharged to the first connector 50A but may be securely discharged through the first wire spring 40A.

The first wire spring 40A is located between the first connector 50A and the belt 140, and the shortest distance between the first wire spring 40A and the belt 140 is shorter than the shortest distance between the first wire spring 40A and the first connector 50A. Therefore, when the electricity charged in the belt 140 may be removed from the belt 140 through the first wire spring 40A reliably.

The holder 120 has the grooves 127, 128, with which the first facing portion 41A may engage. Therefore, the first wire spring 40A may be reliably placed at the correct position in the lengthwise direction with respect to the holder 120.

The holder 120 has the first stopper portion 125B and the second stopper portion 126B. Therefore, the first wire spring 40A may be securely restrained from falling off from the holder 120.

The first facing portion 41A extends straight in the widthwise direction. Therefore, the dimension of the heater 110 and the holder 120 in the lengthwise direction may be effectively reduced.

Although an example of carrying out the invention have been described, those skilled in the art will appreciate that there are numerous variations and permutations of the fuser that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the first and second wire springs 40A, 40B and the first and second connectors 50A, 50B may not necessarily be located in the end areas of the heater 110 on the one and the other sides in the lengthwise direction, respectively. As shown in FIG. 11A, the first wire spring 40A may be located in an end area of the heater 110 on one side in the lengthwise direction, and the first connector 50A may be located in another end area of the heater 110 on the other side in the lengthwise direction. In this arrangement, it may still be desirable that the shortest distance between the first wire spring 40A and the belt 140 is shorter than the shortest distance between the first connector 50A and the belt 140.

For another example, as shown in FIG. 11B, the first wire spring 40A and the first connector 50A may be located in an end area of the heater 110 on one side in the lengthwise direction while the second connector 50B may be located in another end area on the other side of the heater 110 in the lengthwise direction. The first wire spring 40A may be located between the belt 140 and the first connector 50A in the lengthwise direction. In this arrangement, it may still be desirable that the first wire spring 40A is located closer than the first connector 50A and than the second connector 50B to the belt 140.

For another example, as shown in FIG. 11C, the first wire spring 40A may be located in an end area on one side of the heater 110 in the lengthwise direction while the second connector 50B and the second wire spring 40B may be located in another end area on the other end of the heater 110 in the lengthwise direction. The second wire spring 40B may be located between the belt 140 and the second connector 50B in the lengthwise direction.

For another example, as shown in FIG. 11D, solely the first wire spring 40A and solely the first connector 50A may be located in an end area on one side of the heater 110 alone in the lengthwise direction. The first wire spring 40A may be located between the first connector 50A and the belt 140. In this arrangement, it may still be desirable that the shortest distance between the first wire spring 40A and the belt 140 may be shorter than the shortest distance between the first wire spring 40A and the first connector 50A.

For another example, the first facing portion 41A of the first wire spring 40A may not necessarily extend straight across the heater 110 but may be in a curved form. For another example, as shown in FIG. 12, the first wire spring 400A may have a first facing portion 410A, which protrudes toward the heater 110. The first facing portion 410A may press the heater 110 against the supporting face 122A of the holder 120 to retain the heater 110 on the holder 120. In this arrangement, the heater 110 may be securely restrained from being displaced with respect to the holder 120.

For another example, one or more elements in the embodiment and the examples described above may be optionally combined.

What is claimed is:

1. A fuser comprising:

a heater in a form of a planar plate, the heater having a first face and a second face opposite to the first face;

a holder having a supporting base, the supporting base supporting the first face of the heater; and a first wire spring retaining the heater on the holder, the first wire spring having:

a first facing portion facing and supporting the second face of the heater;

a first engageable portion extending from one end of the first facing portion, the first engageable portion being engageable with the holder in an end area on one side of the heater in a widthwise direction, the widthwise direction intersecting orthogonally with a lengthwise direction of the heater; and a second engageable portion extending from the other end of the first facing portion, the second engageable portion being engageable with the heater in an end area on the other side of the heater in the widthwise direction.

2. The fuser according to claim 1, further comprising a fuser frame supporting the holder, wherein the holder has a contacting area, at which the holder contacts the fuser frame along the widthwise direction, and wherein the first wire spring is located in a range, in which at least a part of the first wire spring is located in the contacting area.

3. The fuser according to claim 1, wherein the holder has holes, in which the first engageable portion and the second engageable portion are inserted.

4. The fuser according to claim 1, wherein the first wire spring is grounded.

5. The fuser according to claim 4, further comprising:

a first connector configured to supply power to the heater, the first connector nipping the heater and the holder; and an endless belt having an inner circumferential surface, the inner circumferential surface contacting the heater, wherein a shortest distance between the first wire spring and the belt is shorter than a shortest distance between the first connector and the belt.

6. The fuser according to claim 5, wherein the first wire spring and the first connector are located in an end area on one side of the heater in the lengthwise direction, wherein the first wire spring is located between the first connector and the belt in the lengthwise direction, and wherein the shortest distance between the first wire spring and the belt is shorter than a shortest distance between the first wire spring and the first connector.

7. The fuser according to claim 6, further comprising:

a second wire spring retaining the heater on the holder, the second wire spring having:

a second facing portion facing and supporting the second face of the heater;

a third engageable portion extending from one end of the second facing portion, the third engageable portion being engageable with the holder at a position on the one side of the heater in the widthwise direction; and a fourth engageable portion extending from the other end of the second facing portion, the fourth engageable portion being engageable with the heater at a position on the other side of the heater in the widthwise direction, wherein the second wire spring is located on an end area on the other side of the heater in the lengthwise direction.

8. The fuser according to claim 6, further comprising a second connector configured to supply power to the heater, the second connector nipping the heater and the holder, the second connector being located in the end area on the other side of the heater in the lengthwise direction.

9. The fuser according to claim 8, further comprising:

a second wire spring retaining the heater on the holder, the second wire spring having:

a second facing portion facing and supporting the second face of the heater;

a third engageable portion extending from one end of the second facing portion, the third engageable portion being engageable with the holder at a position on the one side of the heater in the widthwise direction; and a fourth engageable portion extending from the other end of the second facing portion, the fourth engageable portion being engageable with the heater at a position on the other side of the heater in the widthwise direction, wherein the second wire spring is located on the end area on the other side of the heater in the lengthwise direction, and wherein the second wire spring is located between the belt and the second connector in the lengthwise direction.

10. The fuser according to claim 5, wherein the first wire spring is located in an end area on one side of the heater in the lengthwise direction, and wherein the first connector is located in an end area on the other side of the heater in the lengthwise direction.

11. The fuser according to claim 5, wherein the supporting base has at least one opening, wherein the fuser further comprises at least one temperature sensor and at least one urging member, the at least one urging member being configured to urge the at least one temperature sensor against the first face of the heater through the at least one opening in the supporting base, and wherein the at least one temperature sensor is located closer than the first connector to the first wire spring in the lengthwise direction.

12. The fuser according to claim 1, wherein the holder has a groove, with which the first facing portion engages.

13. The fuser according to claim 1, wherein the holder includes:

a first contact wall located in the end area on the one side in the widthwise direction, the first contact wall contacting the first engageable portion, the first engageable portion being in an elastically deformed form; and a second contact wall located in the end area on the other side in the widthwise direction, the second contact wall contacting the second engageable portion, the second engageable portion being in an elastically deformed form.

14. The fuser according to claim 13, wherein the first engageable portion has:

a first extended portion extending from the first facing portion in an orthogonal direction, the orthogonal direction intersecting orthogonally with the lengthwise direction and the widthwise direction; and a first turnback portion bent at an end of the first extended portion, wherein the second engageable portion includes:

a second extended portion extending from the first facing portion in the orthogonal direction; and a second turnback portion bent at an end of the second extended portion, wherein the first turnback portion extending from the end of the first extended portion toward the first facing portion and outward in the widthwise direction contacts the first contact wall, and wherein the second turnback portion extending from the end of the second extended portion toward the first facing portion and outward in the widthwise direction contacts the second contact wall.

15. The fuser according to claim 13, wherein the holder includes:

a first stopper portion extending in the widthwise direction from the first contact wall, the first stopper portion restraining the first engageable portion from separating from the holder in an orthogonal direction, the orthogonal direction intersecting orthogonally with the lengthwise direction and the widthwise direction; and a second stopper portion extending in the widthwise direction from the second contact wall, the second stopper portion restraining the second engageable portion from separating from the holder in the orthogonal direction.

16. The fuser according to claim 1, wherein the first facing portion extends straight in the widthwise direction.

17. The fuser according to claim 1, wherein the first facing portion has a protrusive form protruding toward the heater, the first facing portion being pressed against the heater to retain the heater.

* * * * *